US011203993B2

(12) United States Patent
Damitz et al.

(10) Patent No.: US 11,203,993 B2
(45) Date of Patent: Dec. 21, 2021

(54) METHOD FOR OPERATING AN INTERNAL COMBUSTION ENGINE

(71) Applicant: Robert Bosch GmbH, Stuttgart (DE)

(72) Inventors: Jens Damitz, Markgroeningen (DE); Christian Luz, Rudersberg (DE); Joerg Frauhammer, Gemmrigheim (DE)

(73) Assignee: Robert Bosch GmbH, Stuttgart (DE)

( * ) Notice: Subject to any disclaimer, the term of this patent is extended or adjusted under 35 U.S.C. 154(b) by 520 days.

(21) Appl. No.: 16/319,082

(22) PCT Filed: Jul. 5, 2017

(86) PCT No.: PCT/EP2017/066797
§ 371 (c)(1),
(2) Date: Jan. 18, 2019

(87) PCT Pub. No.: WO2018/015158
PCT Pub. Date: Jan. 25, 2018

(65) Prior Publication Data

US 2021/0332768 A1 Oct. 28, 2021

(30) Foreign Application Priority Data

Jul. 19, 2016 (DE) ..... 102016213147.8

(51) Int. Cl.
*F02D 41/14* (2006.01)

(52) U.S. Cl.
CPC ..... *F02D 41/1447* (2013.01); *F02D 41/1401* (2013.01); *F02D 2041/1412* (2013.01); *F02D 2200/0804* (2013.01); *F02D 2200/701* (2013.01)

(58) Field of Classification Search
CPC ..... F02D 41/1447; F02D 2041/1412; F02D 2200/0804; F02D 2200/701
(Continued)

(56) References Cited

U.S. PATENT DOCUMENTS 6,032,461 A 3/2000 Kinugasa et al.
10,221,744 B2 * 3/2019 Muller ..... F01N 3/023
(Continued)

FOREIGN PATENT DOCUMENTS

CN 1784541 A 6/2006
CN 102140955 A 8/2011
(Continued)

OTHER PUBLICATIONS

International Search Report for PCT/EP2017/066797, dated Sep. 13, 2017.

*Primary Examiner* — Erick R Solis
(74) *Attorney, Agent, or Firm* — Norton Rose Fulbright US LLP; Gerard Messina

(57) ABSTRACT

A method is provided for controlling an internal combustion engine as a function of an expected value of a temperature of a component of an exhaust gas system, route data of an expectable driving route being assigned values of exhaust gas temperatures. The method is characterized in that the route data are assigned engine operating data which are expectable when passing through the expectable driving route and in that a first exhaust gas temperature expected value is computed and assigned to a route section, in that the route is subdivided into characterizable route sections, in that each of these route sections is assigned a predetermined second exhaust gas temperature expected value which is based on at least one exhaust gas temperature value measured at an earlier point in time, and in that the expected value of the temperature of the component is formed on the basis of linking the first exhaust gas temperature expected value to the second exhaust gas temperature expected value.

10 Claims, 3 Drawing Sheets

(58) Field of Classification Search
USPC ..... 701/101
See application file for complete search history.

(56) References Cited

U.S. PATENT DOCUMENTS

| | | | | |
|---|---|---|---|---|
| 2005/0166580 | A1 | 8/2005 | Pfaeffle et al. | |
| 2010/0043404 | A1* | 2/2010 | Hebbale | F01N 9/00 60/286 |
| 2012/0203434 | A1* | 8/2012 | Sujan | B60W 50/14 701/64 |
| 2016/0123260 | A1 | 5/2016 | Bromham et al. | |
| 2017/0211493 | A1* | 7/2017 | Kidd | F02D 41/1401 |
| 2021/0053578 | A1* | 2/2021 | Hashimoto | B60W 40/105 |
| 2021/0215076 | A1* | 7/2021 | Ellmer | F01N 3/2066 |

FOREIGN PATENT DOCUMENTS

| | | | |
|---|---|---|---|
| DE | 102004005072 | A1 | 8/2005 |
| DE | 102008008566 | A1 | 8/2009 |
| DE | 102009038110 | A1 | 4/2010 |
| DE | 102015200235 | A1 | 7/2015 |
| GB | 2393404 | A | 3/2004 |
| WO | 2009088437 | A1 | 7/2009 |
| WO | 2012094646 | A1 | 7/2012 |

* cited by examiner

METHOD FOR OPERATING AN INTERNAL COMBUSTION ENGINE

FIELD OF THE INVENTION

The present invention relates to a method.

The present invention moreover relates to a control unit.

BACKGROUND INFORMATION

Such a method and such a control unit are known, for example, from German Published Patent Application No. 10 2004 005 072. This publication provides a method for controlling an internal combustion engine 10 as a function of an expected value of a temperature of a component 44, 48 of an exhaust gas system 12 of the internal combustion engine 10, route data of an expectable driving route lying ahead of the motor vehicle being assigned values of exhaust gas temperatures. Here, it is taken into account, for example, that an uphill stretch lying ahead of the vehicle results in an increase in the exhaust gas temperature, thus facilitating a regeneration of a soot particulate filter.

SUMMARY

The present invention differentiates itself in its method aspects from the related art mentioned at the outset in that the route data are initially assigned fictitious engine operating data which are expectable when passing through the expectable driving route under certain conditions and in that by using these engine operating data, a first exhaust gas temperature expected value is computed and assigned to a certain point or route section of the expectable driving route, in that the expectable route is subdivided into route sections which are characterizable by a set of parameters, in that each of these route sections is assigned a predetermined second exhaust gas temperature expected value which is based on at least one exhaust gas temperature value measured at an earlier point in time for the same set of parameters, and in that the expected value of the temperature of the component of the exhaust gas system is formed on the basis of linking the first exhaust gas temperature expected value to the second exhaust gas temperature expected value.

In its device aspects, the present invention differentiates itself from this related art by the characterizing features of the independent device claim.

These features serve to improve a prediction of the exhaust gas temperature and/or temperature of components of an exhaust gas system and to expand the prediction horizon. By predicting the temperatures of the exhaust gas and exhaust gas system components on the basis of the future driving route, the engine control is provided with information about the thermal state of these components, also for the future engine operation, with an estimatable probability. This information may be used to optimize the control and/or regulation of the internal combustion engine with regard to the requirements of the exhaust gas system. This results in a reduction of pollutant emissions, at the least possible fuel consumption, in an optimization of diagnostic methods, and in a maximization of the lifetime of components of the exhaust gas system.

One preferred embodiment of the method is characterized in that the first exhaust gas temperature expected value is weighted using a first weighting factor and the second exhaust gas temperature expected value is weighted using a second weighting factor, and in that the weighted first exhaust gas temperature expected value is linked to the weighted second exhaust gas temperature expected value to form a third exhaust gas temperature expected value which represents an exhaust gas temperature directly exhaust gas-downstream from an outlet valve of the internal combustion engine.

It is also preferred that the expected value of the temperature of the component of the exhaust gas system is computed on the basis of the third exhaust gas temperature expected value and on the basis of the thermal properties of the exhaust gas and of the exhaust gas system of the internal combustion engine.

Another preferred embodiment is characterized in that the weighting factors are based on an estimation of the accuracy of the first exhaust gas temperature expected value and/or of the second exhaust gas temperature expected value.

It is further preferred that the route data include at last one of the following types of data: data from a GPS of the motor vehicle, data from a navigation system 28 of the motor vehicle.

It is also preferred that the route data include data from a traffic telematic system.

Another preferred embodiment is characterized in that the route data also include driving data from other motor vehicles which are present on the expectable driving route.

It is also preferred that the route data additionally include data with regard to driver-specific routes and driver operation characteristics.

One preferred embodiment of the control unit is characterized in that it is configured to control the sequence of at least one of the above-mentioned embodiments of the method.

Further advantages result from the dependent claims, the description and the appended figures.

It is understood that the above-mentioned features and the features to be elucidated below are usable not only in the given combination, but also in other combinations or alone without departing from the scope of the present invention.

BRIEF DESCRIPTION OF THE DRAWINGS

Exemplary embodiments of the present invention are illustrated in the drawings and explained in greater detail in the description below. Here, the same reference numerals in different figures correspond in each case to the same or at least functionally comparable elements.

DETAILED DESCRIPTION

Figure 1:
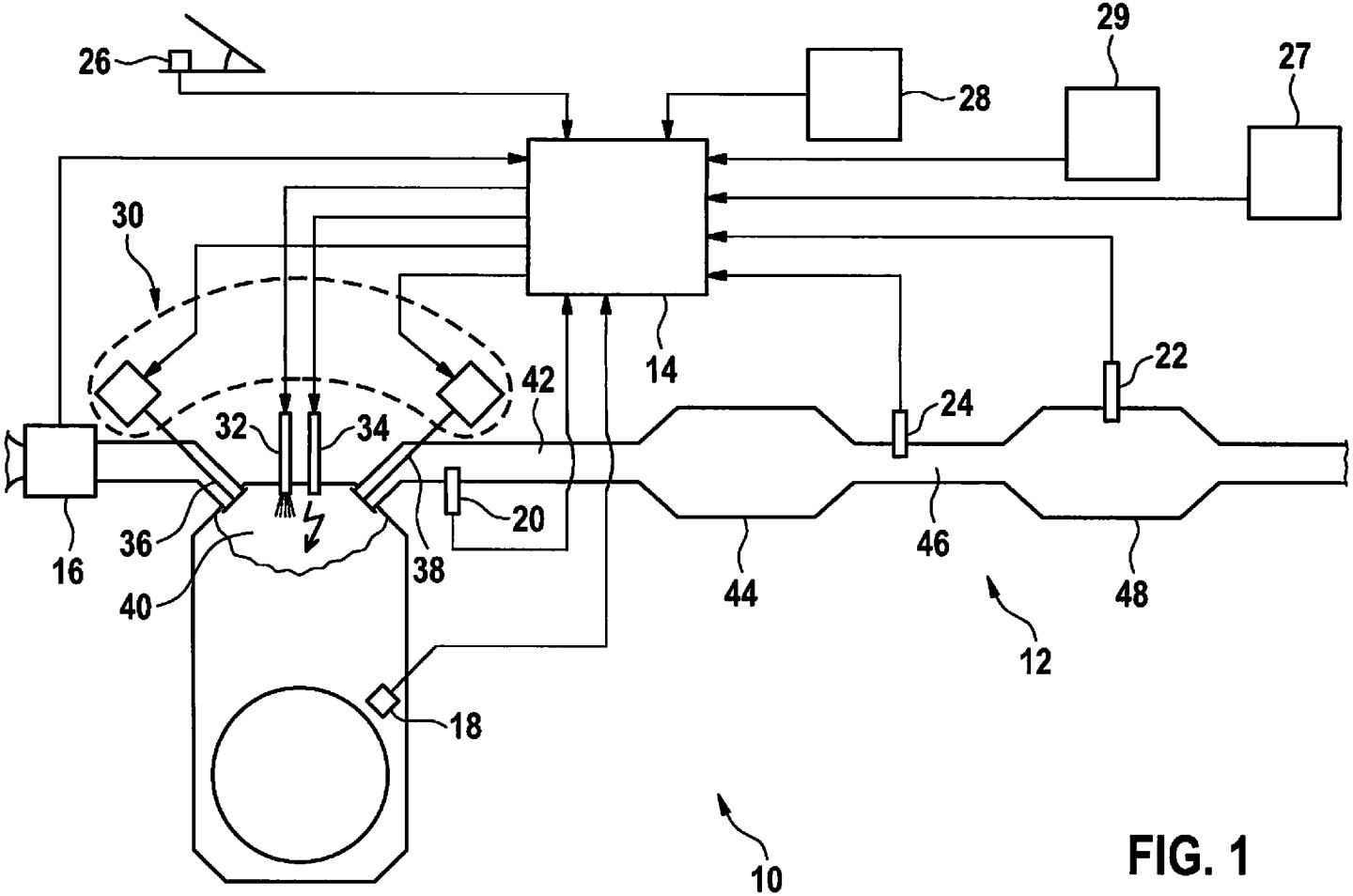
FIG. 1 schematically shows the technical background of the present invention.

In detail, FIG. 1 shows an internal combustion engine 10 including an exhaust gas system 12, a control unit 14, and various sensors and actuators.

Control unit 14 is preferably an engine control unit which controls, for example, the fuel metering, the air supply, and the triggering of combustions through auto-ignition or spark ignition of the combustion chamber fillings of internal combustion engine 10. For this purpose, control unit 14 processes input signals of different detectors to form output signals which are used to control the actuators of the internal combustion engine. The detectors include, for example, an air-mass flow sensor 16, a rotational speed sensor 18, a first exhaust gas temperature sensor 20, a second exhaust gas temperature sensor 22, an exhaust gas sensor 24 which detects the composition of the exhaust gas or the concentration of an exhaust gas component, and a driver input sensor 26 using which the driver requests torque. On the one hand, this list does not claim to be complete and, on the other hand, not all of the above-mentioned sensors must necessarily be present.

Moreover, control unit 14 processes route data which are made available by a navigation system 28 of the motor vehicle. In one embodiment, control unit 14 also processes route data which are available through a data exchange between different vehicles which are present on the same driving route or which are made available by a radio network operator/traffic telematic system. The data exchange between the vehicles takes place via the Internet, for example. If a computation model is discussed in this application, a computation model is meant in each case using which output variables, such as expected temperature values, are computed in control unit 14 from input variables with the aid of equations stored in the control unit. These equations represent in each case the particular computation model.

Control unit 14 uses input signals to form output signals with the aid of which actuators of the motor vehicle are controlled. In the example illustrated above, the actuators are an air mass actuator 30, a fuel quantity actuator 32, and, if an internal combustion engine which operates with spark ignition is involved, an ignition device 34. This list also does not claim to be complete and not all of the above-mentioned actuators must be present either. For example, the ignition device is usually not present in diesel engines. In the example illustrated above, air mass actuator 30 is an arrangement of inlet valves 36 and outlet valves 38 whose opening (duration and/or cross section) is controlled by control unit 14. Fuel quantity actuator 32 is an injector. Ignition device 34 includes a spark plug. These actuators are preferably present individually for each combustion chamber 40 of internal combustion engine 10. Control unit 14 is incidentally configured, in particular programmed, to carry out the method according to the present invention or an embodiment of the method by controlling the particular method sequence.

In the example illustrated above, exhaust gas system 12 includes a first section 42, a first exhaust aftertreatment component 44, a second section 46, and a second exhaust aftertreatment component 48. Exhaust aftertreatment components 44, 48 are a particulate filter and a catalytic converter, for example. Exhaust gas sensor 24, for example a lambda sensor or an NOx sensor, is situated in second section 46, in the present case, and second temperature sensor 22 is situated in or at second exhaust aftertreatment component 48, without the present invention being limited to exactly this arrangement. In one preferred embodiment, control unit 14 models the exhaust gas temperatures in particular for at least one, however preferably for multiple or all sections of the exhaust aftertreatment components of the exhaust gas system.

Figure 2:
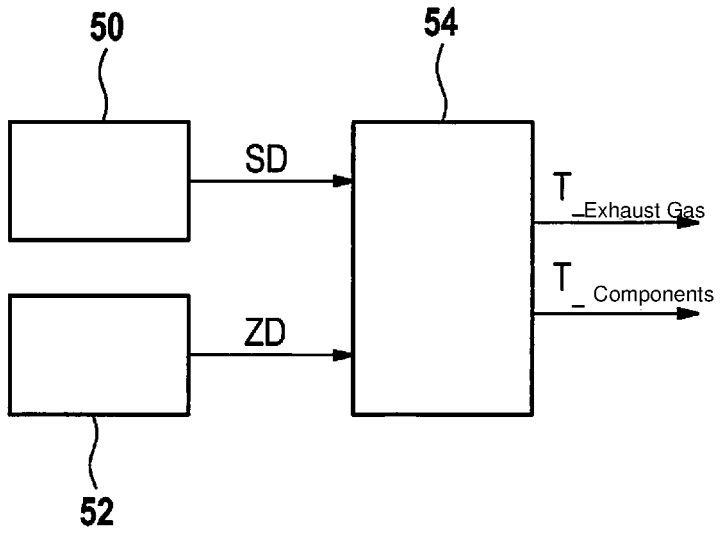
FIG. 2 schematically shows a function block illustration of the present invention.

FIG. 2 shows a function block illustration of a method for forming one or multiple temperature value(s) T_abg of exhaust gases and/or temperature values T_komp of components of an exhaust gas system 12 of an internal combustion engine 10. A first block 50 forms route data SD which characterize an expectable driving route lying ahead of the motor vehicle. These data are, for example, made available by navigation system 28 and include, for example, values of expectable average speeds and uphill and downhill values.

A second block 52 forms additional data which have an expectable effect on a temperature which is expectable for exhaust gas system 12, be it the temperature of a component 44, 48 or of the exhaust gas in this component. These additional data ZD are, for example, driving and route data, which are retrievable via a direct mobile radio connection or, indirectly, via the Internet, from other, for example preceding, vehicles on the same driving route. Another example of additional data are driver-specific data. Depending on the driver, who is recognized via a correspondingly programmed vehicle key, for example, an individual effect on the exhaust gas temperature results based on the individual driving style.

The route data made available by first block 50 and additional data ZD made available by second block 52 are used to compute in advance in third block 54 expected values TE, which are individual to each route section, for one or multiple temperatures of components 44, 48 and/or sections of exhaust gas system 12. As a result, a high exhaust gas and exhaust gas component temperature, which facilitates a regeneration of a particulate filter and/or a desulfurization of a catalytic converter, for example, may be predicted for a driver, for example, who usually drives at a high engine output and for uphill stretches which are devoid of traffic jams and have a sufficient length. These measures are then preferably carried out in this route section. Similarly thereto, route sections which are rather unfavorable for a regeneration or desulfurization may be identified in advance. These measures are then preferably carried out outside of these route sections. The risk that a regeneration or desulfurization, once started, must be aborted prematurely because the exhaust gas temperature unexpectedly decreases, for example, will thus be considerably reduced, which results in reduced pollutant emissions in the total over many regeneration cycles/desulfurization cycles.

Figure 3:
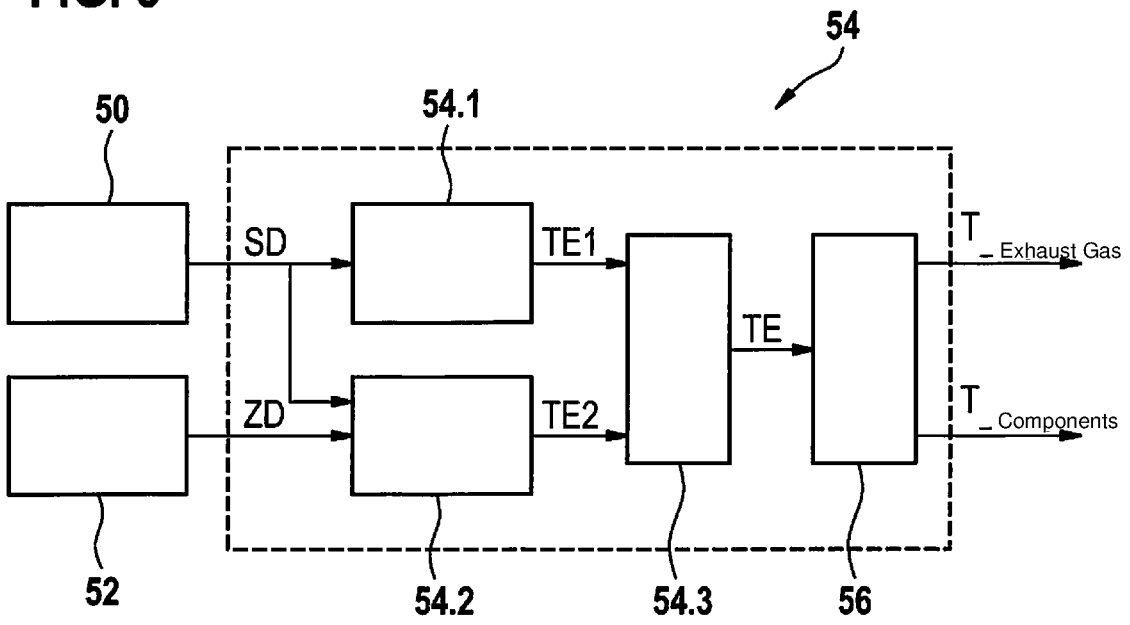
FIG. 3 schematically shows the subject matter of FIG. 2 including further details.

FIG. 3 shows one exemplary embodiment of the present invention in a function block illustration which represents the method aspects as well as the device aspects. FIG. 3 differs from FIG. 2 in the illustration of an internal structure of third block 54. Otherwise, the description of FIG. 2 also applies to FIG. 3.

Block 54 includes a block 54.1 in which a first exhaust gas temperature expected value TE1 is computed from the route data made available by block 50. This first exhaust gas temperature expected value represents the engine outlet temperature prevailing directly behind outlet valves 38 of internal combustion engine 10. For computing the engine outlet temperature, route data are initially assigned fictitious engine operating data which are expectable when passing through the expectable driving route under certain conditions. This assignment takes place with the aid of a computation model of the motor vehicle in which the mass to be accelerated and air resistances, i.e. the driving resistances of the motor vehicle overall, are processed, for example.

These driving resistance values are used to ascertain values for the torque, which is required by internal combustion engine 10 to overcome the driving resistances, and suitable rotational speed values. Operating parameters of internal combustion engine 10, using which these torque values and rotational speed values may be adjusted, are computed from the torque values and rotational speed values thus ascertained. By using these fictitious engine operating data, an engine outlet temperature is computed with the aid of an exhaust gas temperature model, as known from DE 44 24 811 C2 for instantaneously measured engine operating data, for example.

This engine outlet temperature is assigned to an associated point or route section of the expectable driving route. This takes place continuously for representative points or route sections of the expectable driving route. The expectable driving route is subdivided into route sections which are characterizable by a set of parameters. The set of parameters includes, for example, uphill values and average speed values.

When driving through the route sections thus characterized, each of these route sections is assigned in block 54.2 a predetermined second exhaust gas temperature expected value TE2 which is based on at least one exhaust gas temperature value already measured earlier, i.e. while passing through a comparable driving route at an earlier point in time. Predetermined second exhaust gas temperature expected value TE2 is based in particular on an exhaust gas temperature value measured at an earlier point in time for the same set of parameters.

Finally, first exhaust gas temperature expected value TE1 is linked to second exhaust gas temperature expected value TE2 in block 54.3 and an expected value TE of the temperature of the component of the exhaust gas system is also formed in block 54.3 on the basis of this link. The formation takes place, for example, according to equation TE=(1/(G1+G2))*(G1*TE1+G2*TE), where G1+G2=1. In block 56, this expected value TE is used to compute expected values for temperatures T_abg of the exhaust gas at different points of the exhaust gas system and/or expected values of temperatures T_komp of components, such as components 44, 48 of exhaust gas system 12, with the aid of a temperature model of the exhaust tract.

Figure 4:
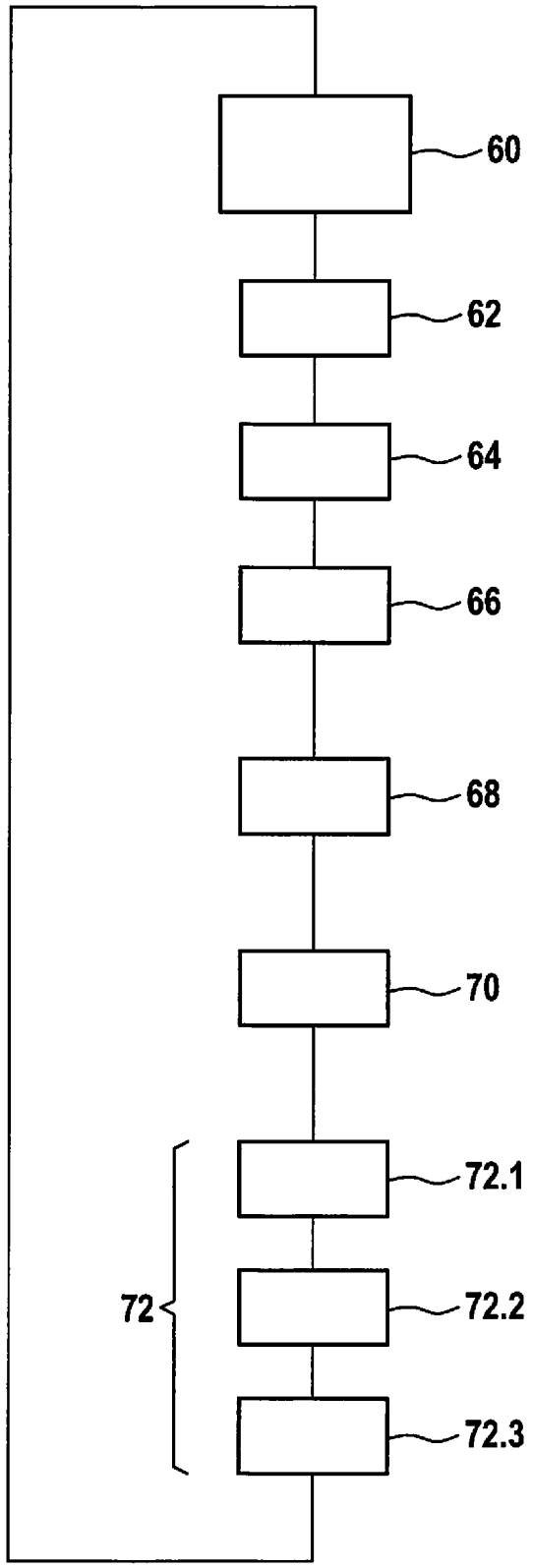
FIG. 4 schematically shows one exemplary embodiment of the method according to the present invention.

FIG. 4 shows a flow chart of a method according to the present invention. The method or the sequence of the method is controlled by control unit 14.

Block 60 corresponds to a superordinate main program HP for controlling internal combustion engine 10. A step or program module 62, in which route data SD of an expectable driving route lying ahead of the motor vehicle are ascertained, is initially extracted from this main program for the control of internal combustion engine 10 which takes place according to the present invention as a function of an expected value of a temperature of a component 44, 48 of an exhaust gas system 12 of internal combustion engine 10.

These route data include, for example, data from a GPS 27 of the motor vehicle and/or data from a navigation system 28 of the motor vehicle and/or data from a telematic system, or mobile data from other motor vehicles from a mobile radio system 29, or the Internet, so that in particular the effect of downhill stretches and uphill stretches on the exhaust gas temperature may be taken into account when forming the exhaust gas temperature expected value. Alternatively or additionally, the route data include data from a traffic telematic system. These data allow for the effect of traffic jams on the exhaust gas temperature to be taken into account, for example. Similarly, this applies to embodiments in which the route data alternatively or additionally include driving data from other motor vehicles which are present on the expectable driving route. This allows in particular for possible and thus expectable average speeds to be taken into account. In another embodiment, the route data additionally include data with regard to driver-specific routes and driver operation characteristics since the exhaust gas temperature also significantly depends on one's personal driving style, at least if the route is free.

Following this step 62, these route data are initially assigned in following program module 64 fictitious engine operating data MD which are expectable when passing through the expectable driving route under certain conditions.

Following this step 64, a first exhaust gas temperature expected value TE1 is computed using these engine operating data and assigned to a certain point or route section of the expectable driving route.

In a step 68, the expectable driving route is subdivided into route sections which are characterizable by a set of parameters.

In step 70, each of these route sections is assigned a predetermined second exhaust gas temperature expected value TE2 which is based on at least one exhaust gas temperature value measured at an earlier point in time for the same set of parameters. Steps 68 and 70 together correspond to block 54.2.

In program module 72, the expected value of the temperature of the component of the exhaust gas system is formed on the basis of linking the first exhaust gas temperature expected value to the second exhaust gas temperature expected value. This corresponds to block 54.3.

For this purpose, the first exhaust gas temperature expected value is preferably weighted using a first weighting factor G1 in a substep 72.1 of program module 72. Moreover, the second exhaust gas temperature expected value is preferably weighted using a second weighting factor G2 in a second substep 72.2 of program module 72 and subsequently in a third substep 72.3 of the program module, weighted first exhaust gas temperature expected value G1 times TE1 is linked to weighted second exhaust gas temperature expected value G2 times TE2 to form a third exhaust gas temperature expected value TE which represents an exhaust gas temperature directly exhaust gas-downstream from an outlet valve of the internal combustion engine. This corresponds to block 54.3. The weighting factors are preferably based on an estimation of the accuracy of the first exhaust gas temperature expected value and/or of the second exhaust gas temperature expected value.

Second exhaust gas temperature expected value TE2 is, for example, assigned a high accuracy, if the route data belong to a driving route, for example a daily travel to work, which is driven repeatedly under similar conditions. A measure for the accuracy is formed, for example, in that every time when a route section which is characterizable by certain route data is driven through, a counter content is increased and in that the measure for the accuracy is formed as a function of the counter content.

In addition, an exhaust gas temperature which is measurable in each case while driving through a route section is detected and stored as belonging to this route section in control unit 14 as a learning value and/or it is made retrievably available to a mobile data service.

First exhaust gas temperature expected value TE1 is, for example, assigned a low accuracy, if the route data belong to a route which has not been driven yet or which is driven only rarely and for which none or only few exhaust gas temperature values measured during earlier driving operations are stored. A measure for the accuracy is formed, for example, in that every time when a route section which is characterizable by certain route data is driven through, a counter content is increased and in that the measure for the accuracy is formed as a function of the counter content.

Depending on the application function, the requirements with regard to the prediction horizon as well as the accuracy of the temperature prediction differ, thus potentially requiring a parallel modeling of several time horizons.

What is claimed is:

1. A method for controlling an internal combustion engine of a motor vehicle as a function of an expected value of a temperature of a component of an exhaust gas system of the internal combustion engine, in which values of exhaust gas temperatures are assigned to route data of an expectable driving route lying ahead of the motor vehicle, the method comprising:

initially assigning to the route data fictitious engine operating data that are expectable when passing through the expectable driving route under certain conditions;

using the fictitious engine operating data to compute a first exhaust gas temperature expected value;

assigning the first exhaust gas temperature expected value to a certain point or route section of the expectable driving route;

subdividing the expectable driving route into route sections that are characterizable by a set of parameters;

assigning each of the route sections a predetermined second exhaust gas temperature expected value that is based on at least one exhaust gas temperature value measured at an earlier point in time for the same set of parameters; and forming the expected value of the temperature of the component of the exhaust gas system on the basis of linking the first exhaust gas temperature expected value to the second exhaust gas temperature expected value.

2. The method as recited in claim 1, further comprising:

weighting the first exhaust gas temperature expected value using a first weighting factor to produce a weighted first exhaust gas temperature expected value;

weighting the second exhaust gas temperature expected value using a second weighting factor to produce a weighted second exhaust gas temperature expected value; and linking the weighted first exhaust gas temperature expected value to the weighted second exhaust gas temperature expected value to form a third exhaust gas temperature expected value that represents an exhaust gas temperature directly exhaust gas-downstream from an outlet valve of the internal combustion engine.

3. The method as recited in claim 2, further comprising computing the expected value of the temperature of the component of the exhaust gas system on the basis of the third exhaust gas temperature expected value and on the basis of thermal properties of exhaust gas and of the exhaust gas system of the internal combustion engine.

4. The method as recited in claim 2, wherein the first weighting factor and the second weighting factor are based on an estimation of an accuracy of at least one of the first exhaust gas temperature expected value and the second exhaust gas temperature expected value.

5. The method as recited in claim 1, wherein the route data includes at last one of:

data from a GPS of the motor vehicle, and data from a navigation system of the motor vehicle.

6. The method as recited in claim 1, wherein the route data includes data from a traffic telematic system.

7. The method as recited in claim 1, wherein the route data includes driving data from another motor vehicle that is present on the expectable driving route or made their data from a previous driving operation on this route retrievably available to a mobile data service.

8. The method as recited in claim 1, wherein the route data includes data with regard to a driver-specific route and a driver operation characteristic.

9. A control unit programmed to control an internal combustion engine of a motor vehicle as a function of an expected value of a temperature of a component of an exhaust gas system of the internal combustion engine, in which values of exhaust gas temperatures are assigned to route data of an expectable driving route lying ahead of the motor vehicle, the control unit programmed to:

initially assign to the route data fictitious engine operating data that are expectable when passing through the expectable driving route under certain conditions;

use the fictitious engine operating data to compute a first exhaust gas temperature expected value;

assign the first exhaust gas temperature expected value to a certain point or route section of the expectable driving route;

subdivide the expectable driving route into route sections that are characterizable by a set of parameters;

assign each of the route sections a predetermined second exhaust gas temperature expected value that is based on at least one exhaust gas temperature value measured at an earlier point in time for the same set of parameters; and form the expected value of the temperature of the component of the exhaust gas system on the basis of linking the first exhaust gas temperature expected value to the second exhaust gas temperature expected value.

10. The control unit as recited in claim 9, the control unit being further programmed to:

weight the first exhaust gas temperature expected value using a first weighting factor to produce a weighted first exhaust gas temperature expected value;

weight the second exhaust gas temperature expected value using a second weighting factor to produce a weighted second exhaust gas temperature expected value; and link the weighted first exhaust gas temperature expected value to the weighted second exhaust gas temperature expected value to form a third exhaust gas temperature expected value that represents an exhaust gas temperature directly exhaust gas-downstream from an outlet valve of the internal combustion engine.

* * * * *